United States Patent [19]

Perez, Jr. et al.

[11] 4,017,987

[45] Apr. 19, 1977

[54] PEDICURE SANDAL

[76] Inventors: Louis A. Perez, Jr., 5215 N. Blvd., Apt. 107, Tampa, Fla. 33603; Galina Tatarenko, 486 S. Arnez Drive, Los Angeles, Calif. 90048

[22] Filed: Jan. 28, 1976

[21] Appl. No.: 653,196

[52] U.S. Cl. ..... 36/11.5

[51] Int. Cl.[2] ..... A43B 3/12

[58] Field of Search ..... 36/11.5, 83, 8.1

[56] References Cited

UNITED STATES PATENTS

| | | | |
|---|---|---|---|
| 2,740,207 | 4/1956 | Starensier | 36/11.5 |
| 2,808,662 | 10/1957 | Webb | 36/11.5 |
| 2,928,191 | 3/1960 | Meltzer | 36/11.5 |
| 3,336,683 | 8/1967 | Schellkopf | 36/11.5 |

*Primary Examiner*—Patrick D. Lawson
*Attorney, Agent, or Firm*—Duckworth, Hobby, Orman, Allen & Pettis

[57] ABSTRACT

A footwear assembly in the form of a sandal or like device designed to be attached to the foot after a pedicure has been performed thereon and specifically configured to both keep the foot from becoming soiled and concurrently separating the various toes of the foot. More specifically, a plurality of finger elements are integrally attached at one end to a plug element which itself is attached to the base portion and disposed to extend upwardly therefrom into separating relation to the toes of the foot on which the footwear assembly is mounted. The base means includes a sole portion which is configured at least in part and preferably entirely in corresponding relation to the configuration of the foot so that upon receiving a pedicure one may place the sandal on the pedicured foot and thereby be mobile without dirtying the foot or ruining the pedicure by inadvertent engagement of the toes of the foot.

8 Claims, 4 Drawing Figures

FIG. 1
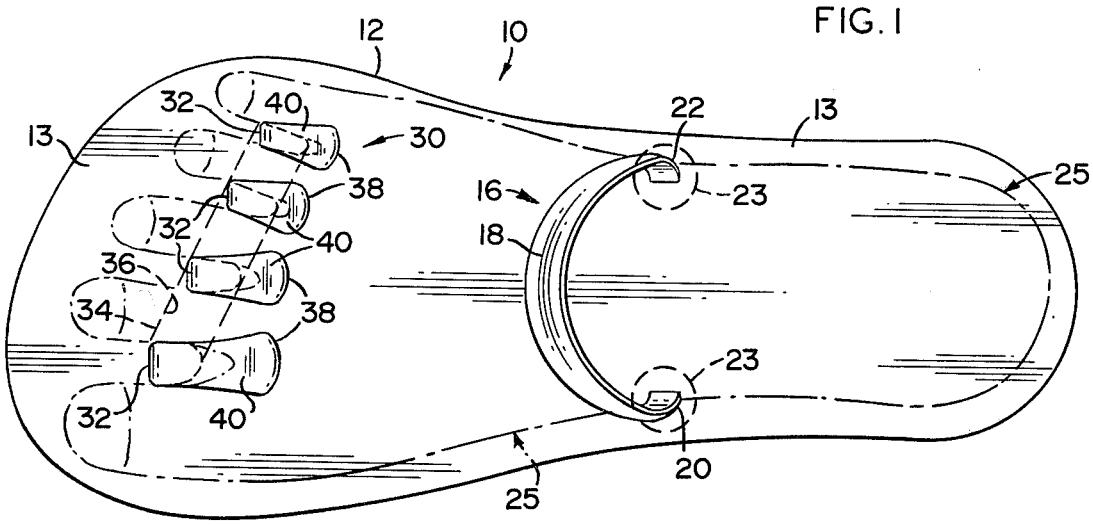
FIG. 2
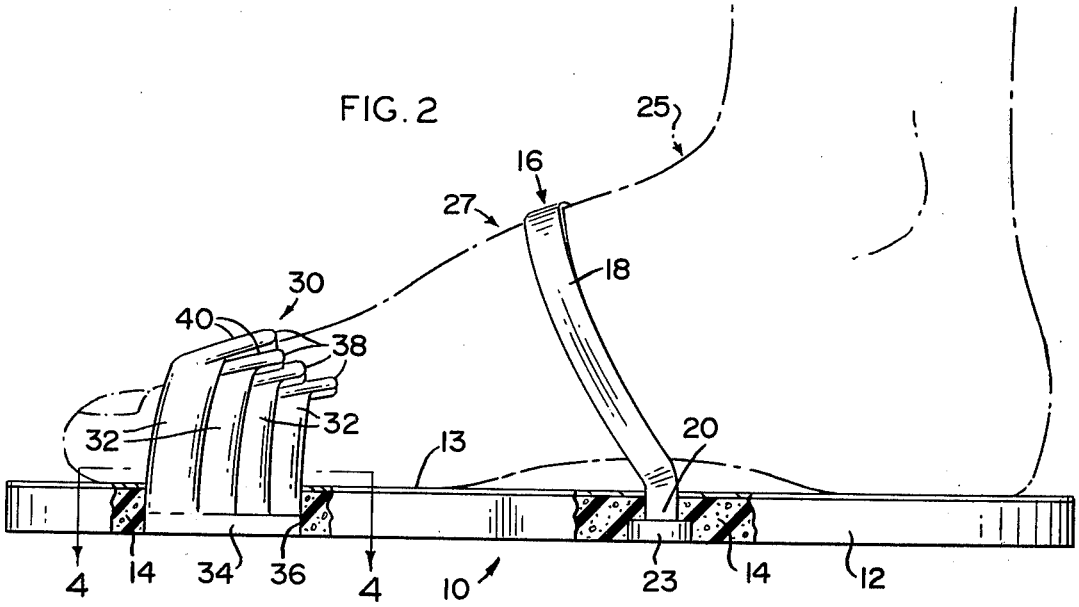
FIG. 3
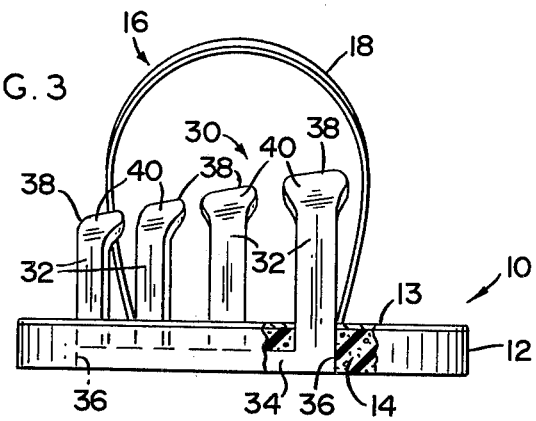
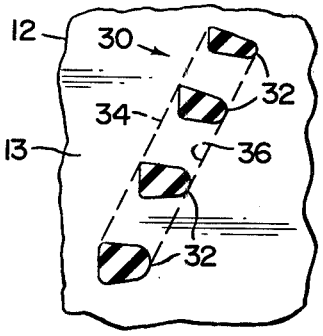
FIG. 4

PEDICURE SANDAL

BACKGROUND OF THE INVENTION

1. Field of the Invention

A sandal primarily designed to be used after a pedicure has been performed on the foot of the user wherein the structure of the sandal is such as to separate each of the toes and also keep the foot from engaging the ground or other supporting surface over which the user walks.

2. Description of the Prior Art

After the performance of a pedicure or any like beautification treatment it is normally required to wait a predetermined length of time before any conventionally designed shoe or slipper may be placed on that foot. During this waiting period it is normally necessary to keep the various toes of the foot separated in order not to "damage" any of the beautification treatment done to the toes such as polish, placement of enamel, etc. In order to accomplish such separation makeshift methods are frequently used whereby tissues of paper or like random articles are placed between the toes for this waiting period.

Similarly, during such waiting period the mobility of one receiving the pedicure is severely limited since walking with the pedicured foot would be both awkward and would have to be accomplished without the use of any foot covering or the like. Therefore, when the pedicure is done professionally such as in a beauty house or the like the one on whom the pedicure is performed is normally forced to be immobile and prevented from walking throughout the house or to a location of more comfort during this predetermined waiting period.

Therefore, there is an obvious need in the cosmetic industry for a footwear assembly specifically designed to meet the requirements of being worn on a foot after receiving a pedicure. The structure of such a footwear assembly could readily be in the form of a sandal which has adequate spacer means efficiently mounted on the base means of the sandal so as to separate the various toes from one another or at the same time allowing the user of the pedicure sandal to freely move about without engaging the ground, floor or other supporting surface directly with the bare foot.

Such a sandal should be simply structured and made from a composition capable of being washed or disposed of after one or a predetermined plurality of uses.

SUMMARY OF THE INVENTION

This invention relates to a footwear assembly primarily in the form of a sandal and more specifically structured and designed to be used after receiving a pedicure.

The present invention comprises a footwear assembly including a base means. The base means comprises a sole portion which is configured at least in part to correspond to the form of the foot. Preferably, however, the sole portion comprises a configuration which corresponds to substantially the configuration or form of the entire foot. In this latter embodiment the sole portion of the base means is sufficiently large to be adaptable to feet of varying size and thereby allow walking or general mobility of the wearer of the pedicure sandal after the pedicure has been performed.

For purposes of clarity only a single sandal will be shown being generally adaptable to either the right or left foot. However, it should be noted that the subject invention comprises a configuration of the sole portion adaptable to either foot or alternatively a specific configuration of the sole portion adapted to both a right and a left foot for complete mobility of the wearer of the foot assembly as set forth above.

A foot connecting means is attached to the base means and may be in the form of a strap made of an elastic material wherein its opposite ends are attached to the base means so as to define the foot connecting means into a substantially loop configuration. This loop configuration serves to substantially surround what may be termed the mid-portion of the foot and thereby provide proper attachment force sufficient to maintain the sole portion of the base means in proper orientation to the undersurface of the foot. Similarly, as set forth above the elastic capabilities of the foot connecting means serves to allow the pedicure sandal to be worn on feet of varying sizes.

Another structural feature of the present invention comprises spacer means in the form of one or more finger elements extending upwardly from the base means into engaging, separating relation to the toes of the foot. This spacer means further comprises a plug element having one end of each of the finger elements integrally attached thereto and extending upwardly therefrom so as also to extend upwardly from the base means into the toe separating relation as set forth above. Each of the finger elements are disposed in predetermined, spaced relation to one another so as to be adequately spaced to maintain adequate separation between the various toes, substantially irrespective of the size of the foot on which the pedicure sandal is mounted. Mounting or attachment of the spacer means and in particular the plug element to the base means is accomplished through the provision of a depression formed in the undersurface or portion of the base means. This plug element and the formed depression are substantially of corresponding configurations such that fitting of the plug element can readily be accomplished with a minimal of time, effort and skill on the part of the laborer assembling such sandal structure.

The finger elements themselves are of varying longitudinal dimensions so as to extend upwardly from the base at different heights and thereby correspond to the natural form or configuration of the foot itself.

Another structural feature of the present invention includes each free end of each finger element comprising a substantially enlarged surface area on which various indicia means including advertising or decorative feature may be placed. Such free end includes what may be termed as flange elements extending substantially rearwardly relative to the toe or front portion of the foot thereby adding the capability to the structure of the sandal of either being more highly decorative or having the versatility of applying informative or advertising indicia thereon.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the invention, reference should be had to the following detailed description taken in connection with the accompanying drawings which:

FIG. 1 is a top plan view of the footwear assembly as shown mounted on the foot of a wearer.

FIG. 2 is a side view in partial section of the structure shown in FIG. 1.

FIG. 3 is a front view in partial section showing the plug element with finger elements attached to the base means.

FIG. 4 is a section taken along line 4—4 of FIG. 2 showing detail of the finger elements.

Similar reference characters refer to similar parts throughout the several views of the drawings.

DETAILED DESCRIPTION

As shown in FIGS. 1, 2 and 3 the footwear assembly of the present invention is generally indicated as 10 including a base means 12. The base means has included thereon a sole portion 13 specifically configured along with the base means to cover at least a portion and preferably all of the foot of the wearer. More specifically, the configuration of the sole portion 13 and the base means 12 is such as to substantially correspond to the form of the human foot. However, such configuration of the sole portion 13 and base means 12 should be such that feet of varying dimensions can be placed on the sole portion without engaging the ground, floor or supporting surface over which the wearer walks. As best shown in FIG. 2 the base means includes a cushion means 14 made from sponge rubber or any like or conventional material capable of providing certain cushioning support to the foot when the wearer thereof is actually walking.

Foot connecting means is generally indicated as 16 comprising strap member 18. Opposite ends of the strap member 20 and 22 are fixedly attached to the base means 12 by tab elements 23 or like connecting means which serve to secure the strap 18 in substantially surrounding relation to the foot 25. Disposition of the strap element 18 is such as to surround substantially the mid-portion of the foot 25 which may be generally indicated as 27. While the strap element 18 may be placed in other locations relative to both the base means 12 and the foot 25, it has been found that the mid-portion 27 is perhaps the most efficient manner of connecting the footwear assembly to the foot 25. Preferably, the strap 18 is formed from an elastic maaterial so as to readily adapt itself to the various dimensions and/or configurations of the foot 25 on which the pedicure sandal is placed.

Spacer means generally indicated as 30 comprises at least one and preferably a plurality of finger elements 32 each having one end thereof integrally connected to a plug element 34. The plug element is fitted within a depression means 36 having a correspondingly configuration to that of the plug means 34. Wherein the plug means 34, during assembly of the sandal may be fitted within the depresson 36 so as to dispose the finger elements 32 in outwardly extending relation relative to plug 34 and to the base means 12. The longitudinal dimension of each of the finger elements 34 or the degree of outward extension from the base means 12 and the sole means 13 varies so as to meet the natural configuraton of the foot and particularly the toes which are separated by the specific positioning of the finger elements 32 in spaced relation to one another.

In addition each of the finger elements 32 comprise flange means 38. Each of the flange means has an enlarged surface area 40 on which may be placed various decorative designs or alternately informative or advertising indicia means thereon.

Accordingly, after receiving a pedicure the particular foot is placed in the sandal such that the finger elements 32 of the spacer means are properly positioned relative to the toes of the foot so as to keep them in spaced relation to one another. The flexibility of strap 18 is such as to conform to feet of various sizes and configuration and allow proper positioning of the base means relative to the undersurface of the foot.

It will thus be seen that the objects set forth above, among those made apparent from the preceeding description, are efficiently attained, and since certain changes may be made from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A footwear assembly of the type primarily designed for use after pedicure, said footwear assembly comprising: base means including a sole portion configured to correspond to at least a portion of a foot on which said footwear assembly is mounted, foot connecting means interconnected to said base means and disposed in at least partially surrounding relation to the foot, spacer means mounted on said base means and including a plurality of finger elements extending outwardly from said base means between the toes of the foot, each of said spacer means further comprising a plug element mounted on said base means, each of said finger elements having one end integrally attached to said plug element, each of said plurality of finger elements further comprising a free end disposed opposite to the end thereof attached to said plug element, each free end defined by an enlarged surface portion, said plurality of finger elements extending from said plug element and disposed to extend outwardly from said base means into separating relation to the toes of the foot.

2. A footwear assembly as in claim 1 wherein said base means comprises a depression formed in undersurface thereof and substantially corresondingly configured to said plug element, said plug element mounted in said depression, said one finger element extending from said plug and outwardly from said base means into separating engagement with the toes of the foot.

3. A footwear assembly as in claim 2 wherein said spacer means comprises a plurality of finger elements having one end integrally connected to said plug element and extending outwardly from said base means into separating relation to the toes of the foot.

4. A footwear assembly as in claim 1 wherein each of said finger elements comprise varying longitudinal dimensions and thereby extend from said base means at different heights.

5. A footwear assembly as in claim 1 further comprising indicia means mounted on said enlarged surface portion of at least some of said finger elements.

6. A footwear assembly as in claim 1 wherein said foot connecting means has its opposite ends secured to said base means, the remainder of said foot connecting means comprising a substantially elastic strap defining a substantially loop configuration disposed in surrounding relation to the foot.

7. A footwear assembly as in claim 1 wherein said base means further comprises cushion means formed therein and disposed between the foot and the supporting surface on which the footwear assembly is mounted.

8. A footwear assembly as in claim 1 wherein said sole portion is configured to correspond to substantially the entire foot, whereby the foot is kept from engaging a supporting surface after a pedicure.

* * * * *